United States Patent [19]

Bentley

[11] 4,324,812

[45] Apr. 13, 1982

[54] METHOD FOR CONTROLLING THE FLOW OF COATING MATERIAL

[75] Inventor: Stanley L. Bentley, Indianapolis, Ind.

[73] Assignee: Ransburg Corporation, Indianapolis, Ind.

[21] Appl. No.: 154,496

[22] Filed: May 29, 1980

[51] Int. Cl.[3] ..... B05D 1/04

[52] U.S. Cl. ..... 427/8; 427/33

[58] Field of Search ..... 427/8, 10, 33; 118/630, 118/631, 663, 668, 671, 712

[56] References Cited

U.S. PATENT DOCUMENTS

| | | | |
|---|---|---|---|
| 3,527,651 | 9/1970 | Shelffo et al. | 427/8 |
| 3,872,824 | 3/1975 | Erny et al. | 427/10 |
| 4,036,167 | 7/1977 | Lu | 427/10 X |

*Primary Examiner*—Bernard D. Pianalto

*Attorney, Agent, or Firm*—Jenkins, Coffey, Hyland, Badger & Conard

[57] ABSTRACT

A system for adjusting the flow rate of charged particulate coating material between a device for dispensing the coating material and an article, or "target," to be coated by such material to account for factors, such as variations in the profile or contour of the target, or movement of the target transversely to the direction of motion of a conveyor upon which the target is being conveyed past the device or head, which might otherwise cause variations in the thickness of the coating material. The particles migrate in a known manner under the influence of an electrical field toward the target for deposition on the target to coat it at high deposition efficiency. The system continuously monitors the current flow to the target. The system feeds back this current flow related signal to a coating material flow rate servomechanism.

3 Claims, 3 Drawing Figures

160
598
592
590
588
36
32
34
586
584
548
600
604
602
606
608
398
524
522
554
526
528
550
552
556
532
530
558
562
534
536
560
30
564
540
538
566
568
570
542
572
28
554
580
582
546
612
616
618
610
614
24
26

METHOD FOR CONTROLLING THE FLOW OF COATING MATERIAL

This invention relates to a control systems, and more particularly to a control system for an electrostatic coating apparatus for controlling the flow rate of coating material between an atomizing device or head and a target to be coated by atomized coating material particles dispensed from the head. Typically, articles to be coated by an electrostatic coating apparatus are conveyed past the coating apparatus on a conveyor. Such articles are subject to motion, not only past the apparatus, but also oscillatory motion, e.g., swinging motion toward and away from the high voltage electrode of the coating apparatus. Additionally, such articles typically have profiles or contours which are not perfectly flat in planes parallel to their direction of motion along the conveyor. Many of these profile or contour variations concentrate or dissipate the strength of the electrical field between head and target, causing variations in the pattern (e.g., shape and size) of the coating material deposit on the target. Therefore, it is frequently desirable, in order to obtain even thickness coatings in spite of such spacing variations, contour variations, and the like, to vary the coating material flow rate as the profile, contour, or movement of the target dictates. The coating material flow rate can be controlled by a servovalve, and the control system of the present invention can be incorporated into the control for such servovalve.

Reference is here made to U.S. Pat. No. 4,075,677 and U.S. Pat. No. 4,187,527. This is a related application to application Ser. No. 154,494, filed of even date herewith, assigned to the same assignee as the present invention, and titled HIGH VOLTAGE ADJUSTMENT SYSTEM and application Ser. No. 154,495, filed of even date herewith, assigned to the same assignee as this invention and titled POSITION ADJUSTMENT SYSTEM.

In industrial electrostatic coating systems, high voltage direct current power supplies are used which produce across a pair of terminals potentials having high magnitudes, for example, 140 kilovolts (KV) DC. Typically, one of the terminals is at ground or approximately ground potential while the other terminal is held at a high-magnitude (frequently negative) potential. This last, or high potential, terminal typically is connected to a charging device which charges particles of the coating material. The atomized and charged material moves through the electric field between the charging device and the article in the direction of the article, strikes the article, and sticks to it. Generally, the article is maintained at a low potential, e.g., approximately ground, just as is the low potential terminal of the high voltage supply.

In a typical automatic electrostatic coating installation, articles to be coated are frequently carried on a conveyor and are free to swing back and forth in the direction of the charging device. As an article to be coated moves toward the charging device, the potential gradient between the device and the article can increase quite rapidly. The rapidity of the increase depends in part upon how rapidly the article is swinging. The maximum and minimum values of the potential gradient depend upon the amplitude of the swing of the article. The current between the charging device and the article varies as the potential gradient between the article and the charging device varies, the current increasing as the spacing between the article and charging device decreases toward a minimum, and decreasing as the spacing between the article and the charging device increases to a maximum. Appreciation of these characteristics of such coating apparatus has been amply demonstrated by U.S. Pat. Nos. 3,851,618; 3,875,892; 3,894,272; 4,075,677; and 4,187,527.

As can be appreciated, a considerable portion of the current flow between head and target is directly attributable to the spacing between the head and target. Target characteristics, such as profile or contour, cause concentration or dissipation of the electrical field about such characteristics. Since the current which flows to any given area of the target is controlled essentially by the shape of the field in that area, areas where the field is concentrated (e.g., an automobile detail line or "peak") tend to draw more current, resulting in a heavier coating. Conversely, in areas where the field is not concentrated (e.g., "flat" areas), the coating tends to be lighter.

According to the invention, a system for controlling the flow of a flowable coating material from a coating material dispensing device to a target to be coated with such coating material includes a source of coating material and a valve for controlling the flow of coating material from the source to the dispensing device. The valve includes a control input. Means are provided for establishing a potential difference between the dispensing device and the target for creating an electric field between the device and target for charging particles of the coating material which are dispensed from the dispensing device into the field so that the particles move along under the influence of the field to the target to coat it. Means are provided for sensing the current flow from the dispensing device to the target. Additional means are provided for coupling the sensing means to the control input so that a tendency of the current to decrease results in an increase material flow rate through the valve, and a tendency of the current to increase results in a decrease in the coating material flow rate through the valve. Coating material dispensed per unit surface area of the target, or coating material thickness on the target, thereby remains substantially constant.

According to an illustrative embodiment, the means for coupling the sensing means to the control input includes a summing point. The system further includes a coating material adjustment means for selectively adjusting the normal rate of coating material flow through the valve, and thereby the normal thickness of coating material on the target. Such coating material adjustment means are coupled to the summing point.

Further according to the present invention, a method for controlling the flow of a flowable coating material from a coating material dispensing device to a target to be coated by the coating material includes the steps of providing a source of the coating material, controlling the flow of coating material from the source through the device with a valve having a control input, establishing a potential difference between the device and the target to maintain an electric field between the device and target, and charging the particles of coating material dispensed from the device into the field so that the particles move through the field from the device to the target to coat it. Additionally according to the method, the current flow from the dispensing device to the target is sensed, and a signal related to the sensed current is generated. The sensed current-related signal is coupled to the control input. A tendency of the sensed current to decrease causes an increase in the flow of coating material through the device, and a tendency of the sensed current to increase causes a decrease in the flow of coating material through the device. The amount of coating material dispensed per unit surface area of the target, or the thickness of the coating material deposited on the target, thereby remains substantially constant.

The invention may best be understood by referring to the following description and accompanying drawings which illustrate the invention. In the drawings:

DESCRIPTION OF THE PREFERRED EMBODIMENTS

Figure 1:
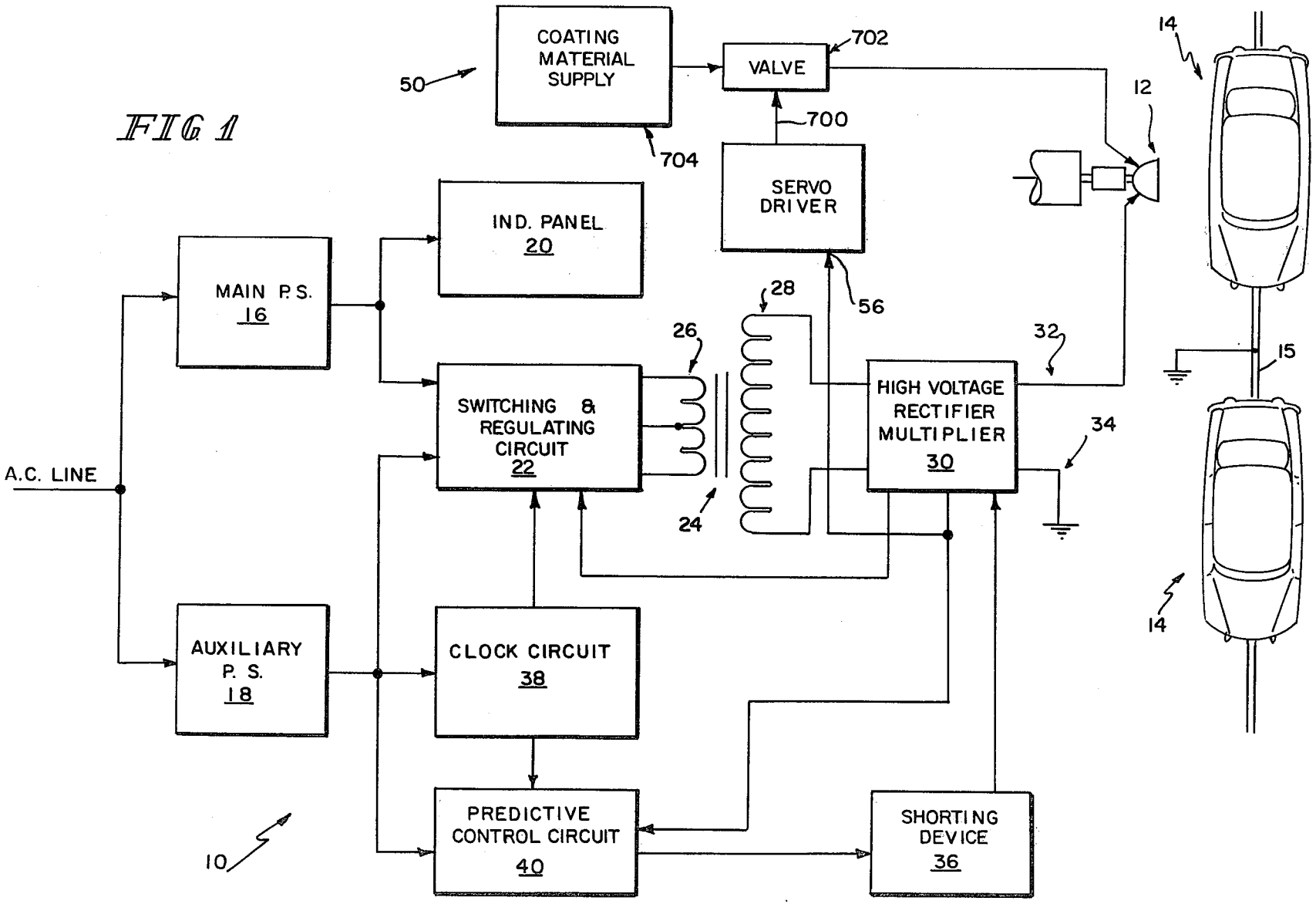
FIG. 1 is a simplified block diagram of a coating system utilizing the position adjustment system of the present invention.

Turning now to FIG. 1, an automatic system 10 for electrostatic, high voltage deposition of coating material from an atomizing and charging head 12 upon articles 14, illustratively car bodies, as they move along past the atomizing and charging head 12 on a grounded conveyor 15 is as described in the above-identified U.S. Pat. Nos. 4,075,677 and 4,187,517. Briefly, the system includes a main power supply 16 for producing direct current at an intermediate voltage, e.g., 28 volts. In addition, an auxiliary power supply 18 is provided to produce direct current at one or more relatively low voltages, e.g., plus or minus 15 volts.

System 10 further includes a control and indicator panel 20 from which the operating status of the system is continuously displayed. To produce the large magnitude voltage necessary for electrostatic deposition, e.g., negative 140 kilovolts (KV), a switching and regulating circuit 22 and a high voltage transformer 24 are provided. High voltage transformer 24 includes a primary winding 26 and a secondary winding 28.

A high voltage rectifier and multiplier 30 is coupled to the secondary winding 28 of transformer 24. Articles 14 are maintained at or near the potential of one of a pair of high voltage output terminals 32, 34. High voltage rectifier and multiplier 30 produces across terminals 32, 34 sufficient potential so that atomized particles of coating material, e.g., paint, will be attracted toward and deposited upon articles 14.

A clock circuit 38 drives switching and regulating circuit 22 to switch the main power supply 16 voltage across primary winding 26 and produce high voltage in secondary winding 28.

Articles 14 are typically conveyed past atomizing and charging head 12 on conveyor 15. Thus, articles 14 are movable with respect to atomizing and charging head 12 and it is desirable to control the potential across output terminals 32, 34 such that, as the contours of the articles 14, or the transverse movement of the articles 14 on conveyor 15, tend to concentrate the field about a point on the target 14, a coating material flow rate adjustment control system 50 tends to reduce the coating material flow rate toward such point on the article 14, thereby maintaining a substantially constant coating material thickness between such point and surrounding areas where the field is not so concentrated. Similarly, as movement of the articles 14 transversely of their direction of motion on conveyor 15, or the contours of articles 14 themselves, tend to dissipate the field about a point on an article 14, the control system 50 tends to increase the coating material flow rate, again maintaining substantially constant coating material thickness between such point and surrounding areas where the field is more concentrated.

Turning now to the details of the control system 50 for adjustment of the coating material flow rate from head 12, reference will be made to FIGS. 2–3.

Figure 2:
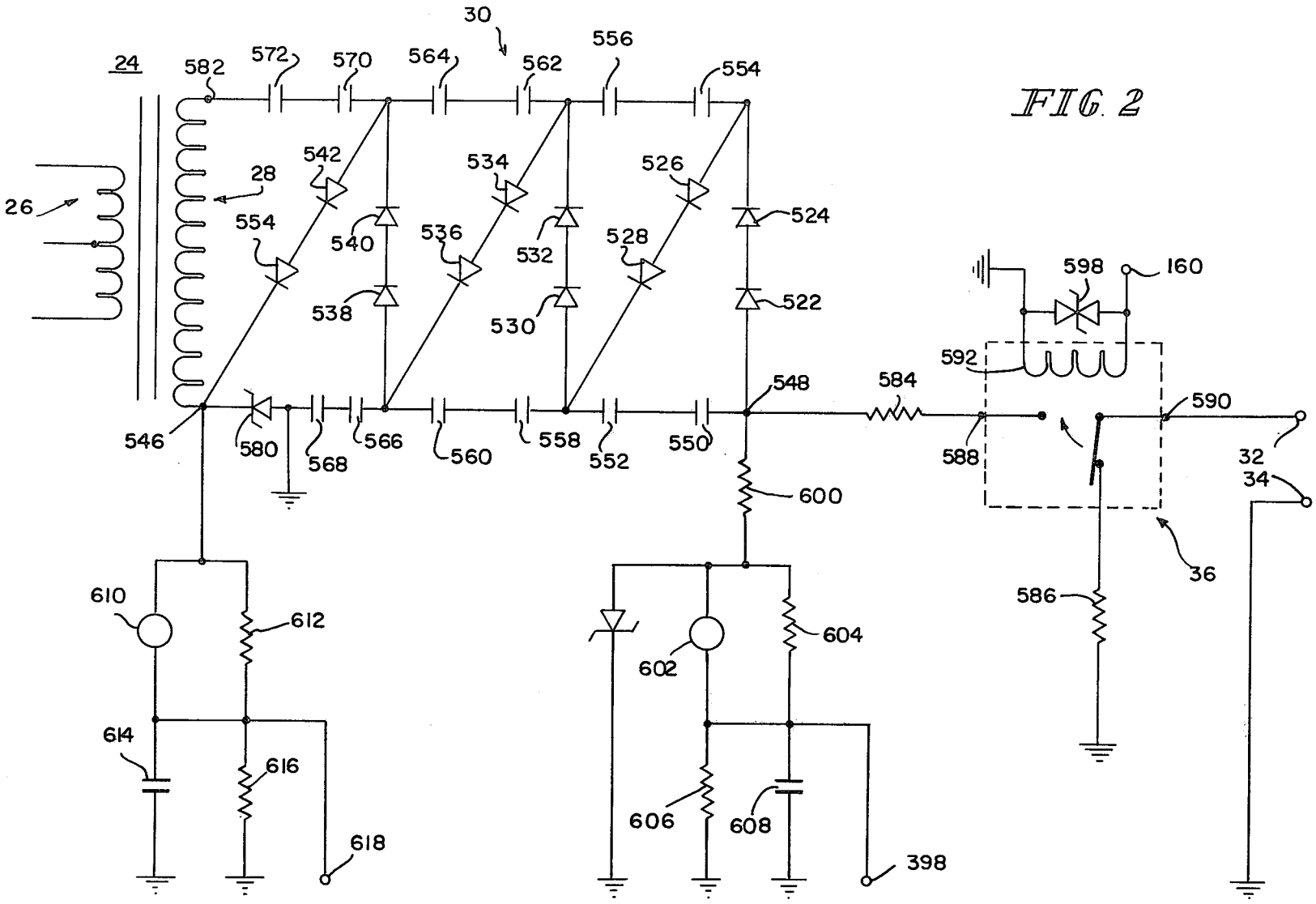
FIG. 2 is a partly block and partly schematic diagram of a portion of the system illustrated in FIG. 1, showing the position adjustment system is somewhat greater detail; and, FIG. 3 is a partly block and partly schematic diagram of a portion of the system illustrated in FIG. 1, showing the position adjustment system is somewhat greater detail.

FIG. 2 illustrates in greater detail the high voltage rectifier and multiplier 30 and its associated circuitry.

High voltage rectifier and multiplier 30 generates a high-magnitude negative voltage, e.g., −140 KV DC. To generate this high voltage, the voltage variations induced in high voltage transformer 24 secondary winding 28 are rectified and multiplied, illustratively by a factor of six, in circuit 30. Twelve high voltage rectifying diodes 522–544 are coupled in series between terminal 546 of secondary winding 28 and the negative high voltage terminal 548. Six pairs of series-coupled storage capacitors 550, 552; 554, 556; 558, 560; 562, 564; 566, 568; and 570, 572 are coupled, respectively, between the anode of diode 522 and the anode of diode 530; the cathode of diode 524 and the cathode of diode 532; the anode of diode 530 and the anode of diode 538; the cathode of diode 532 and the cathode of diode 540; the anode of diode 538 and the anode of a Zener diode 580, the cathode of which is coupled to terminal 546; and the cathode of diode 540 and the other terminal 582 of secondary winding 28.

A large-value series resistor 584 is coupled between negative high voltage terminal 548 and output terminal 32. A series combination of a resistor 586 and terminals 588, 590 of a shorting device 36 are coupled between terminal 32 and ground. Terminals 588, 590 are the normally closed terminals of a solenoid-actuated relay. The control solenoid 592 of this relay is serially coupled between terminal 160 of the control panel 20 (FIG. 1) and ground. A bidirectional Zener diode 598 is also coupled between terminal 160 and ground to protect against excessive voltage across solenoid 592. When winding 592 is actuated, high voltage is supplied from terminal 548 through resistor 584 and device 36 to terminal 32. Any interruption of current flow through winding 592 returns device 36 to its position illustrated in FIG. 2, shorting output terminal 32 through resistor 586 to ground. Device 36 is, for example, the Model KC-7 switch available from Kilovac Corporation, Santa Barbara, California.

High voltage circuit 30 additionally includes some sensing circuits. One terminal of a very large-value resistor 600 is coupled to terminal 548. The remaining terminal of resistor 600 is coupled to the parallel combination of a kilovolt meter 602 and a meter-scale controlling resistor 604. The other terminal of this parallel combination is terminal 398 of active filter 400 of FIG. 3. The parallel combination of a large-value resistor 606 and a capacitor 608 is coupled between terminal 398 and ground. In the circuit including resistors 600, 606, the resistance value of the parallel combination of KV meter 602 and scale resistor 604 is negligible compared to the values of resistors 600 and 606. Thus, resistors 600, 606 constitute an extremely high resistance voltage divider between negative high potential terminal 548 and ground. As was previously mentioned, a voltage signal directly related to the high voltage at terminal 548 is available at terminal 398.

One terminal of a parallel combination of a microammeter 610 and a scale resistor 612 is coupled to terminal 546 of secondary winding 28. A parallel combination of a capacitor 614 and a current-sensing resistor 616 is coupled between the other terminal 618 of the microammeter-scale resistor circuit and ground. Since the junction of high voltage capacitor 568 and Zener diode 580 is at ground, it can be seen that terminal 618 will be maintained at a slightly positive potential (less than or equal to the reverse breakdown voltage of Zener diode 580). Since the microammeter 618 circuit is coupled between terminal 546 of secondary winding 28 and ground, the current through the circuit will be equal to the current flowing between terminals 32, 34 of high voltage circuit 30. The voltage at terminal 618 will always be directly proportional to the current flowing between terminals 32, 34.

Figure 3:
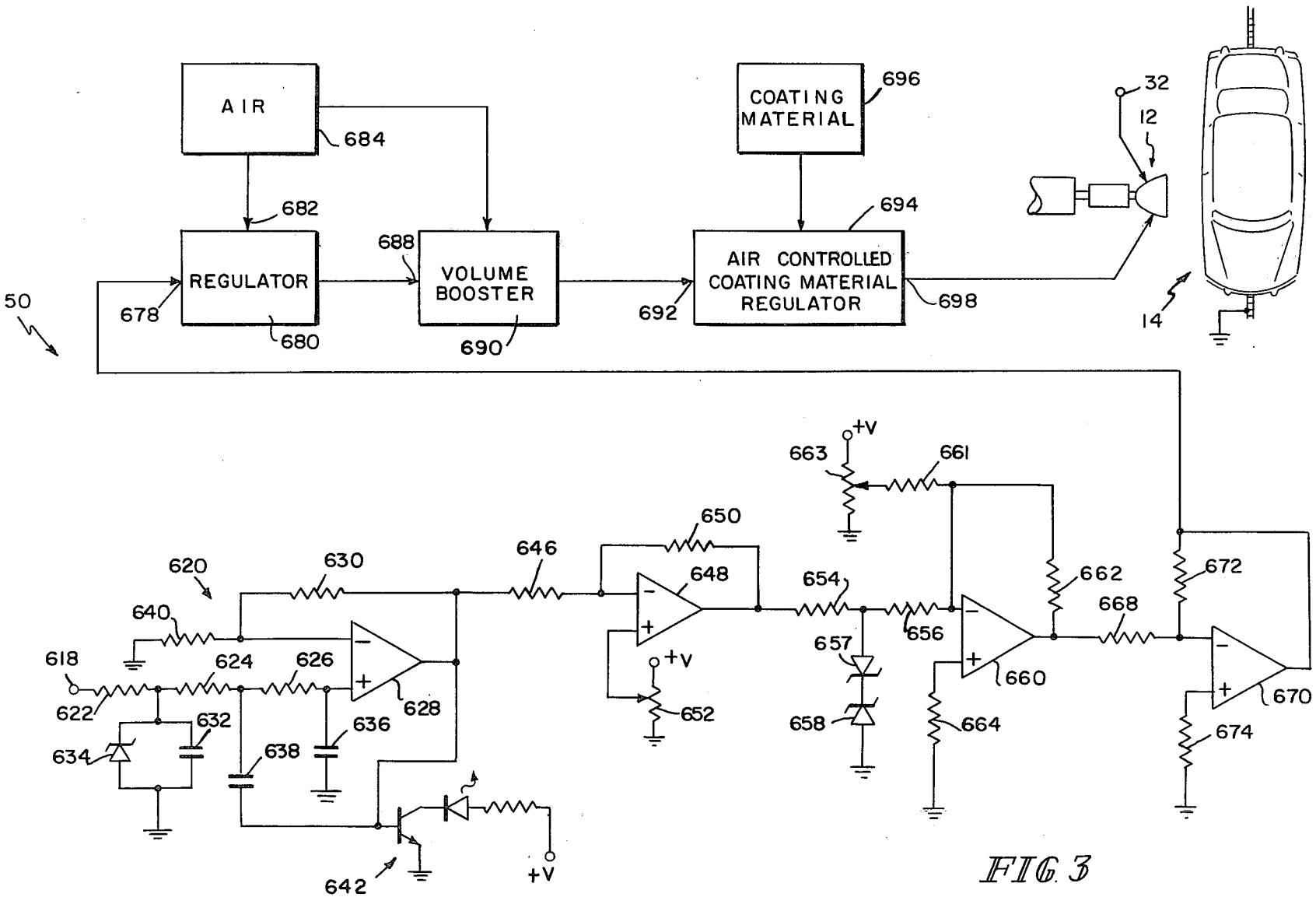

Turning now to FIG. 3, the manner in which the signals generated by these sensing circuits are used will be discussed. The signal representative of current flow between high voltge circuit 30 terminals 32, 34 is coupled from terminal 618 to a three-pole active filter 620. Filter 620 is a Butterworth filter which includes three series reistors 622, 624, 626 coupled between terminal 618 and the non-inverting input terminal (+) of an amplifier 628. The output terminal of amplifier 628 is coupled through a feedback resistor 630 to the inverting input terminal (−) of amplifier 628. A capacitor 632 is coupled between the junction of resistors 622, 624 and ground, as is a Zener diode 634, the anode of which is coupled to ground. A capacitor 636 is coupled between the non-inverting input terminal (+) and ground. A capacitor 638 is coupled between the output terminal and the junction of resistors 624, 626. The inverting input terminal (−) is coupled to ground through a resistor 640. An indicator circuit 642 including a transistor-controlled LED provides a visual indication of the presence of signal at the output terminal of amplifier 628 of filter 620.

The signal at the output terminal of amplifier 628 of filter 620 is a signal containing substantially no alternating current conponents above the corner frequency of the filter 620. This signal is a DC and low-frequency signal related to current flow between the head 12 and target 14. As will be appreciated, a signal containing information relative to the current flow between head 12 and target 14 contains information relative to the concentration or dissipation of the field about a point, or in an area, of target 14 which is receiving coating material. This can be appreciated by remembering that the intensity of the field at target 14 will be interpreted by the high voltage rectifier and multiplier 30, and by terminals 32, 34 as a variable load resistance, with the resistance value being essentially related to concentration or dissipation of the field at target 14. The greater the dissipation, the greater the resistance, and therefore the lower the current. Conversely, the greater the concentration, the less the resistance, and the greater the current. Of course, other factors contribute to the current flow between the head 12 and target 14. Typically, however, within the range of current values with which the present invention is concerned, these other factors can generally be ignored.

The output terminal of amplifier 628 is coupled through a resistor 646 to the inverting input terminal (−) of an amplifier 648. The output terminal of amplifier 648 is coupled through a feedback resistor 650 to the inverting input terminal (−) thereof. The non-inverting input terminal (+) of amplifier 648 is coupled to the wiper of a potentiometer 652. The output terminal of amplifier 648 is coupled through series resistor 654, 656 to the inverting input terminal (−) of an amplifier 660. The junction of resistors 654, 656 is coupled to the anode of a Zener diode 657. The cathode of Zener diode 657 is coupled to the cathode of Zener diode 658, the anode of which is coupled to ground. The output terminal of amplifier 660 is coupled through a feedback resistor 662 to the inverting input terminal (−) thereof. The inverting input terminal (−) of amplifier 660 is also coupled through a resistor 661 to the wiper of a potentiometer 663. The non-inverting input terminal (+) of amplifier 660 is coupled through a resistor 664 to ground.

The output terminal of amplifier 660 is coupled through a resistor 668 to the inverting input terminal (−) of an amplifier 670. The output terminal of amplifier 670 is coupled through a feedback resistor 672 to the inverting input terminal (−) thereof. The non-inverting input terminal (+) of amplifier 670 is coupled through a series resistor 674 to ground. The output terminal of amplifier 670 is also coupled to an electrical input signal terminal 678 of a servoair regulator 680. Regulator 680 can be of any suitable type, such as the Fairchild Model No. servoair regulator, available from Fairchild Industries, Inc. Regulator 680 also includes an air input terminal 682 which is coupled to a suitable air source 684. The air output terminal of regulator 680 is coupled to an input terminal 688 of a volume booster 690. Volume booster 690 is also coupled to the air source 684. The output terminal of volume booster 690 is coupled to an air signal input terminal 692 of an air-controlled coating material flow regulator 694. Coating material is provided from a coating material source 696 through regulator 694 under the control of the signal at terminal 692 to an output terminal 698 of regulator 694. Output terminal 698 is coupled through a suitable conduit to the atomizing head 12. Head 12 can be of any suitable type, such as that illustrated in U.S. Pat. No. 4,148,932.

In operation, the high voltage generator return current-related signal provided at terminal 618 is filtered in the filter 620 to provide at the output terminal of amplifier 628 an essentially DC current related signal. This signal is compared in amplifier 648 to a voltage established on potentiometer 652. Potentiometer 652 sets a limit on the amount of change in coating material flow rate which will be permitted by the system of FIG. 3. Zener diodes 657, 658 also help to establish both maximum and minimum coating material flow rates which will be tolerated by the system of FIG. 3. It will be appreciated that the signal at the anode of Zener diode 657 is, under normal operating conditions, related to the output signal from amplifier 628, that is, the current flow between head 12 and target 14. That signal is summed with a signal provided from potentiometer 663. Typically, the signal at the anode of Zener diode 657 will be negative. The DC value provided from potentiometer 663 through resistor 661 is positive. The DC value established across potentiometer 663 can be considered as the desired "normal" coating material flow rate from head 12. Thus, it will be immediately appreciated that the positive signal related to the desired "normal" coating material flow rate, and the negative signal related to the current flow between head 12 and target 13, are both fed through the inverting and buffer amplifiers 660, 670 to the control input of the servoair regulator 680. It will be immediately appreciated that the combined signal thus controls the amount of coating material delivered to head 12 for atomization and dispensing onto the target 14.

What is claimed is:

1. A method for controlling the flow of coating material from a coating material dispensing device to a target to be coated with the coating material, including the steps of providing a source of the coating material, controlling the flow of coating material from the source through the device with control means having a control input, establishing a potential difference between the device and the target to maintain an electric field between the device and target, charging the particles of coating material dispensed from the device into the field so that the particles move through the field from the device to the target to coat it, sensing the current flow, generating a signal related to the sensed current, and coupling the sensed current-related signal to the control input, a tendency of the sensed current to decrease causing an increase in the flow of coating material through the device, and a tendency of the sensed current to increase causing a decrease in the flow of coating material through the device.

2. A method for controlling the flow of coating material from a coating material dispensing device to a target to be coated with the coating material, comprising the steps of sensing the electrical current from the dispensing device, generating a control signal in response to the sensed current flow and controlling the flow of material to the dispensing device in response to the control signal.

3. The method of claim 2 wherein the step of controlling the flow of material to the dispensing device comprises reducing the flow of coating material to the device as the current flow tends to increase, and increasing the flow of coating material to the device as the current flow tends to decrease.

* * * * *